US009550131B2

(12) United States Patent
Loetz et al.

(10) Patent No.: US 9,550,131 B2
(45) Date of Patent: Jan. 24, 2017

(54) INTERACTIVE TOY FIGURINE

(71) Applicant: Lumination LLC, North Hills, CA (US)

(72) Inventors: Lee Loetz, Oak Park, CA (US); Anna Lee, Burbank, CA (US)

(73) Assignee: LUMINATION LLC, North Hills, CA (US)

( * ) Notice: Subject to any disclaimer, the term of this patent is extended or adjusted under 35 U.S.C. 154(b) by 193 days.

(21) Appl. No.: 13/630,575

(22) Filed: Sep. 28, 2012

(65) Prior Publication Data

US 2014/0094085 A1 Apr. 3, 2014

(51) Int. Cl.

| | |
|---|---|
| ***A63H 33/26*** | (2006.01) |
| ***A63H 3/00*** | (2006.01) |
| ***A63H 3/28*** | (2006.01) |

(52) U.S. Cl.

CPC ..... *A63H 33/26* (2013.01); *A63H 3/001* (2013.01); *A63H 3/006* (2013.01); *A63H 3/28* (2013.01); *A63H 2200/00* (2013.01)

(58) Field of Classification Search

CPC ..... A63H 3/003; A63H 3/006; A63H 3/28; A63H 3/46; A63H 33/046; A63H 33/042; A63H 33/26; A63H 2200/00

USPC ..... 446/91, 92, 97, 101, 130, 139, 175, 268,446/297, 484, 485

See application file for complete search history.

(56) References Cited

U.S. PATENT DOCUMENTS

| | | | | | |
|---|---|---|---|---|---|
| 3,266,187 | A * | 8/1966 | Felsher | A63H 33/26 | 446/130 |
| 3,945,139 | A * | 3/1976 | Miller | G09F 13/04 | 335/205 |
| 4,237,647 | A * | 12/1980 | Shaw | A63H 3/28 | 446/303 |
| 5,114,376 | A * | 5/1992 | Copley | A63H 3/006 | 446/369 |

(Continued)

FOREIGN PATENT DOCUMENTS

| | | | |
|---|---|---|---|
| DE | 29921747 | U1 | 3/2000 |
| GB | 2196545 | A * | 5/1988 |
| WO | 2008096134 | A2 | 8/2008 |

OTHER PUBLICATIONS

International Search Report dated Feb. 18, 2014 for International Application No. PCT/US2013/061256 filed Sep. 23, 2013, 5 pages.

*Primary Examiner* — Gene Kim
*Assistant Examiner* — Alyssa Hylinski
(74) *Attorney, Agent, or Firm* — Snell & Wilmer L.L.P.

(57) ABSTRACT

A plurality of toy and accessory figurines are provided which may be arranged in any number of configurations to provide a response upon the formation of a closed electrical circuit. The toy figurines comprise two electrical contacts which, when closed with an external connection source, provide a response stimuli, such as one or a combination of light, sound and/or motion. The toy figurines may be configured to provide the closed electrical circuit. Alternatively, direct skin contact with the electrical contacts may provide the closed electrical circuit. The accessory figurines provide a further level of interaction. The accessory toy figurines comprise a magnetic switch which is actuated between an open configuration and a closed configuration. The magnetic switch is actuated to a closed configuration to close the electrical circuit when in proximity with a conductive metal, (Continued)

such as the electrical contact of the toy figurine, to deliver a response stimuli.

11 Claims, 5 Drawing Sheets

(56) References Cited

U.S. PATENT DOCUMENTS

| | | | | | |
|---|---|---|---|---|---|
| 5,295,889 | A | | 3/1994 | Ejima | |
| 5,362,271 | A | * | 11/1994 | Butt | A63H 33/26 446/129 |
| 6,139,394 | A | * | 10/2000 | Maxim | A63H 3/006 446/219 |
| 6,142,846 | A | * | 11/2000 | Ojakaar | A63H 3/006 446/369 |
| 6,524,159 | B1 | * | 2/2003 | Kawarizadeh | A63H 5/00 446/397 |
| 7,297,044 | B2 | * | 11/2007 | Small | A63H 30/04 446/175 |
| 7,405,372 | B2 | * | 7/2008 | Chu | H03K 17/9645 200/511 |
| 7,825,346 | B2 | * | 11/2010 | Chu | A61F 13/42 200/511 |
| 8,376,807 | B2 | * | 2/2013 | Fogarty | A63H 33/26 446/369 |
| 2001/0041495 | A1 | * | 11/2001 | Chan | A63H 3/16 446/268 |
| 2002/0111107 | A1 | * | 8/2002 | Lehavi | A63H 3/16 446/101 |
| 2004/0038620 | A1 | | 2/2004 | Small et al. | |
| 2006/0217030 | A1 | | 9/2006 | Lashinsky | |
| 2007/0072161 | A1 | * | 3/2007 | Bugrov | G09B 23/18 434/300 |
| 2009/0215358 | A1 | | 8/2009 | Moothedath et al. | |

* cited by examiner

INTERACTIVE TOY FIGURINE

FIELD

Interactive toy figurines as disclosed herein are particularly provided in the form of one or a plurality of touch responsive toy figurines which may be arranged in a variety of configurations to provide a response upon the formation of a closed circuit.

BACKGROUND

Toy figurines are among the most popular category of toys for children. The popularity of toy figurines derive, in part, from the children's imagination and interest in mimicking interpersonal or social interactions that the children observe in the real world. Toy figurines provide the outlet for children to recreate these interactions.

Over the last 50 years, toy figurines have evolved from being static reproductions of animals and characters having a range of dynamic features. Toys which are responsive to stimuli provided by the child have proven to be immensely popular, such as the Furby®. The nature and level of interaction of the toy may significantly enhance the child's play experience.

As children tend to quickly lose interest in toys that are static, toys which provide a creative way of interaction and which promote a child's creativity in configuring the interaction are in great demand.

SUMMARY

In one embodiment, a toy figurine is described. The toy figurine has a body having an internal cavity and an external surface. A response unit is coupled to a power source receiving unit, the response unit being configured to deliver one or more response stimuli. Electrical contacts are exposed on the external surface of the body. The electrical contacts are disposed at a distance from one another and are each being coupled to the response unit by connectors. The response unit delivers the response stimuli upon the provision that an external connection source provide an electrical connection between the electrical contacts.

In accordance with a first aspect of the embodiment, the body comprises a head, a body and a pair of arms and legs. The electrical contacts are provided on opposing arms or legs.

In accordance with a second aspect of the embodiment, the electrical contacts are provided at terminal ends of the arms, the terminal ends being dome-shaped.

In accordance with a third aspect of the embodiment, the toy figurine further comprises magnets adjacent to the electrical contacts.

In accordance with a fourth aspect of the embodiment, the response unit comprises a printed circuit board (PCB).

In accordance with a fifth aspect of the embodiment, the one or more response stimuli is any one of or a combination selected from the group consisting of light, sound and/or motion.

In accordance with a sixth aspect of the embodiment, the one or more response stimuli comprises a light source and a reflector disposed adjacent the light source. The light source and reflector are both disposed within the internal cavity of the body.

In accordance with a seventh aspect of the embodiment, the body or a portion thereof is made of a transparent, semi-transparent or translucent material that permits the transmittance of light from the light source.

In accordance with an eighth aspect of the embodiment, the toy figurine further comprises a power source.

In accordance with a ninth aspect of the embodiment, the power source is one or more batteries.

In another embodiment, a toy accessory figurine is described. The toy accessory figurine comprises a body having an internal cavity and an external surface. A response unit is coupled to a power source and configured to deliver one or more response stimuli. A switch is coupled to the response unit via connectors and is configured to be actuated between an open state and a closed state.

In accordance with a first aspect of the embodiment, the response unit delivers the response stimuli upon the actuation of the switch to a closed state to complete the electrical circuit.

In accordance with a second aspect of the embodiment, the switch is a magnetic switch that is biased in an open state.

In accordance with a third aspect of the embodiment, the magnetic switch actuates to the closed state to complete the electrical circuit when a conductive element, e.g., made from metal, is placed in close proximity to the magnetic switch.

In accordance with a fourth aspect of the embodiment, the switch, the power source, the response unit, and the switch are all disposed within the internal cavity of the body.

In accordance with a fifth aspect of the embodiment, the one or more response stimuli is any one or a combination selected from the group consisting of light, sound and/or motion.

In a further embodiment, a configurable interactive toy system is described. The system comprises one or a plurality of a first toy figurine(s) and optionally one or a plurality of second toy figurine(s). The first toy figurine(s) each has a body comprising at least two electrical contacts disposed externally of the body. The electrical contacts are each coupled to a response unit. One or more magnets are disposed at a location on the first figurine to cause adjacent ones of a plurality of first set of toy figurines to establish and maintain a physical contact with one another at the electrical contacts. The first toy figurine is configured to be in physical contact with at least another one of the first toy figurine.

In accordance with a first aspect of the embodiment, the response unit delivers one or more response stimuli when a plurality of the first toy figurines establishes physical contact to form a closed circuit wherein no electrical contact is exposed.

In accordance with a second aspect, the response unit delivers a response stimuli when the plurality of the first toy figurines establish physical contact with one another to form an open circuit and an external connection source is provided to close the open circuit.

In accordance with a third aspect of the embodiment, where only one of the first toy figurine is provided, a response stimuli is provided when an external connection source is provided to close the open circuit.

In accordance with a fourth aspect of the embodiment, a plurality of first toy figurines is provided, the plurality of first toy figurines being configurable to form a closed circuit such that the response units of each one of the plurality of first toy figurines deliver a response stimuli.

In accordance with a fifth aspect of the embodiment, the system further comprises one or a plurality of a second toy figurine(s). The second toy figurine(s) each comprise a body having an internal cavity. A magnetic switch is operable between an open state and a closed state and coupled to a response unit being configured to deliver one or more response stimuli upon actuation of the magnetic switch to the closed state.

In accordance with a sixth aspect of the embodiment, the electrical contact of the first toy figurine is placed in proximity to the magnetic switch of the second toy figurine to actuate the magnetic switch to the closed state to complete the electrical circuit upon which the response unit of the second toy figurine delivers the response stimuli.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DESCRIPTION OF THE DRAWINGS

Illustrative embodiments of the present invention are described herein with reference to the accompanying drawings, in which.

Like numerals refer to like parts throughout the several views of the drawings provided herein.

DETAILED DESCRIPTION

Specific, non-limiting embodiments of interactive toy figurines will now be described with reference to the drawings. It should be understood that such embodiments are by way of example only and merely illustrative of but a small number of embodiments within the scope the interactive toy figurines as disclosed herein. Various changes and modifications obvious to one skilled in the art of toy figurines as disclosed herein are deemed to be within the spirit, scope and contemplation of the disclosure as further defined in the appended claims.

Figure 1:
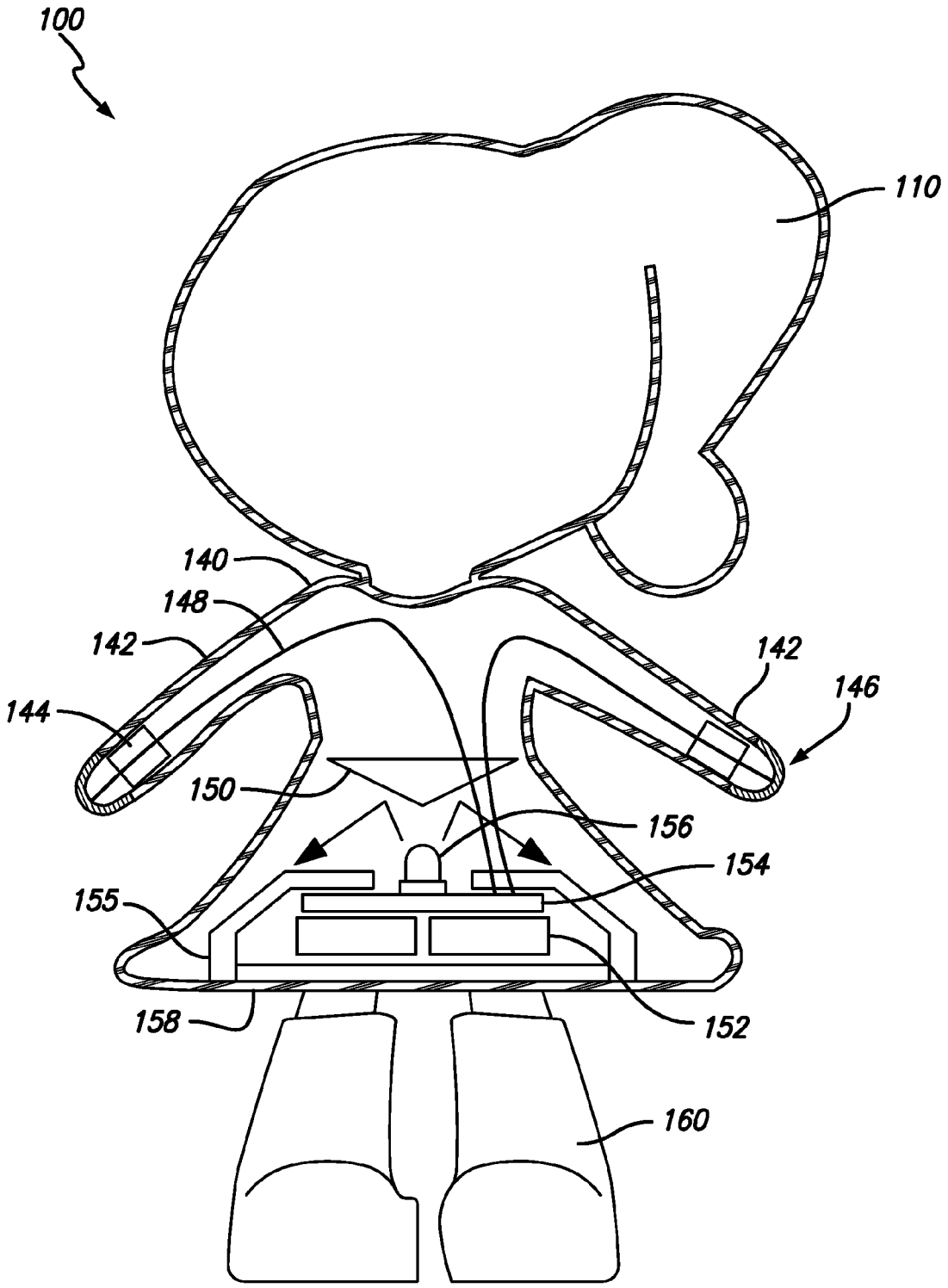
FIG. 1 illustrates a schematic front view an example embodiment of a toy figurine as disclosed herein.

FIG. 1 illustrates an example embodiment toy figurine 100. Although the toy figurine 100 is depicted to take the form and shape of a young girl, it is understood that embodiments of the toy figurines as disclosed herein may take the form of any characters, real or fictional. The toy figurine 100 generally comprises a head 110, a body 140 and a pair of legs and attached feet 160.

Electrical contacts 146 are provided on the terminal ends of the arms 142. The electrical contacts 146 are provided along the external surface of the toy figurine 100 such that direct physical contact may be easily made with the electrical contacts 146 by an external object. The electrical contacts 146 are connected to a printed circuit board (PCB) 154 or the like disposed within an internal chamber or cavity of the toy figurine by electric wires or connectors 148.

The PCB 154, in turn, is electrically connected to a power source 152 and to a stimuli source, such as an LED light 156 or the like. The stimuli source can be disposed within the internal cavity or can be positioned adjacent a wall surface of the figurine, e.g., to project outwardly therefrom.

The PCB is a mechanical structure that provides support for mounting electronics and electrical components which are connected with conducting traces or wires. PCBs are designed to perform a specific electrical or logical function and thus the manner in which the PCB board will work will depend on the intended stimuli to be provided by the stimuli source.

The power source 152 may be one or a plurality of batteries, electrically connected in series or in parallel. The power source may also be an externally mounted photovoltaic cell or other means by which an electrical current may be generated. The batteries may be housed within a compartment 155 disposed within the internal cavity of the toy figurine 100 and accessible by a door 158. In order to enhance the safety of the toy figurine, the door 158 can be affixed to the toy figurine by way of one or more screws or other child-proof closure.

It is understood that the stimuli source may be any one or a combination of light, sound, motion and/or vibration. Where the stimuli source is light, such as the LED light 156 shown in FIG. 1, reflectors 150 may optionally be provided in proximity to the light source 156 to direct the light to a specific area or region or to enhance the lighting effect. Because the light source 156 is depicted as being disposed within the internal cavity of the toy figurine 100 in FIG. 1, on or more select portions, or the entirety of the body 140 of the toy figurine 100, may be made of a transparent, semi-transparent or translucent material that permits the light to be visible. It is understood that the stimuli source may be disposed in any location within the internal cavity or the exterior of the toy figurine 100. For example, the stimuli source may comprise a pair of external lights in the head 110 to represent eyes.

As can readily be seen in FIG. 1, the toy figurine 100 has an open electrical circuit. As a result, the toy figurine 100 by itself will not be capable of producing the stimuli source, in this case, activating the LED light 156. In order for the toy figurine 100 to produce a stimuli source, the electrical circuit will need to be closed. This may be accomplished in any number of ways and permits for the large number of configurations where a plurality of toy figurines is provided.

In one embodiment, the open electrical circuit represented by the one toy figurine 100 is closed where an external connection source is provided. The external connection source may be anything that is capable of conducting electricity.

Figure 2:
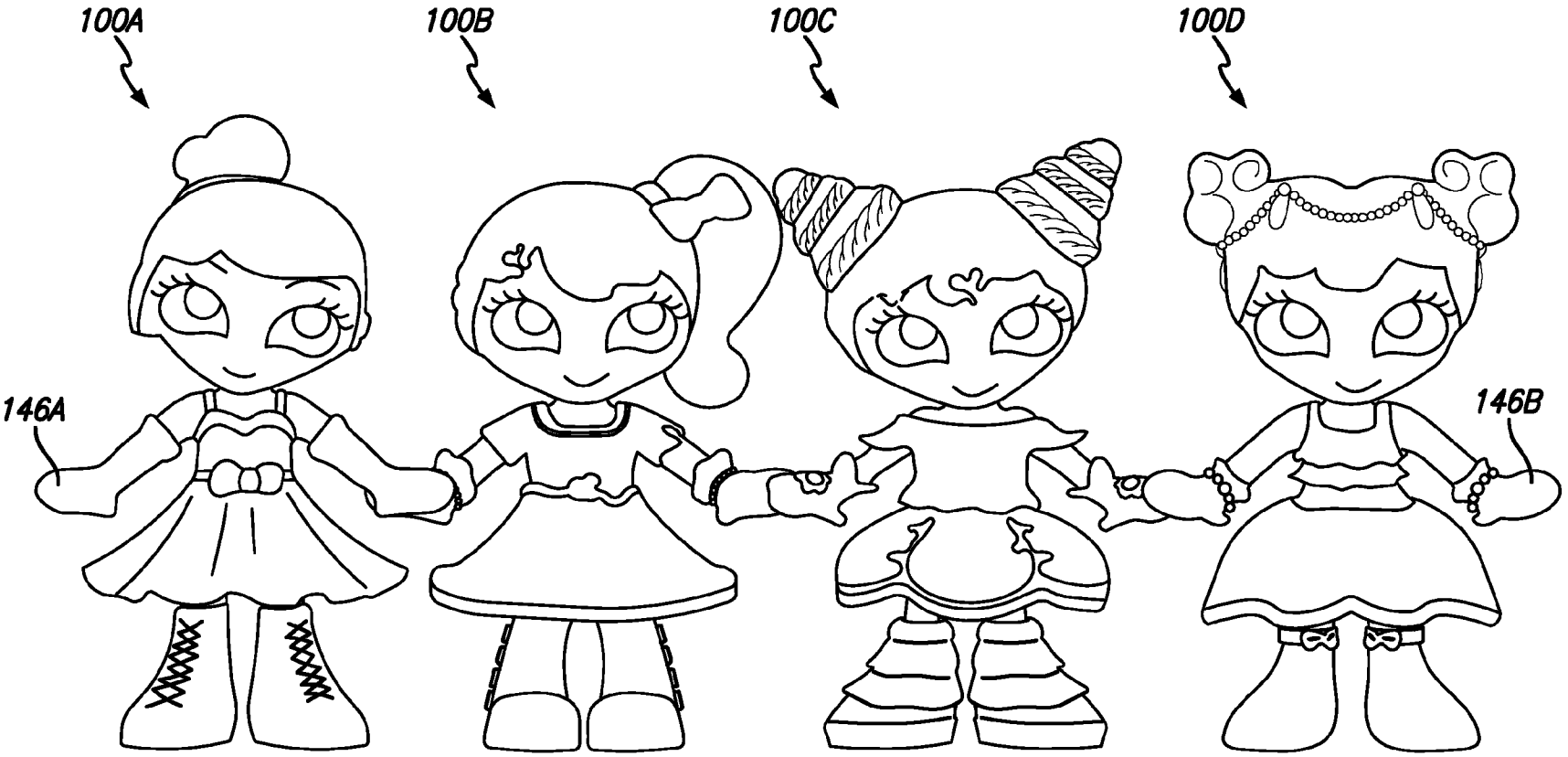
FIG. 2 illustrates front views of a plurality of different toy figurines coupled together to form an open electrical circuit.

In accordance with one aspect, the external connection source can be a single person and the electrical circuit is closed when both of the electrical contacts 146 are in direct contact with a person's skin. This may be accomplished, for example, when a single person holds each one of the electrical contacts 146 at the same time. This may also be accomplished where, as shown in FIG. 2, there is a plurality of toy figurines 100A, 100B, 100C, and 100D and the electrical contacts of adjacent toy figurines are in series contact with one another and the exposed electrical contacts 146A, B of toy figurines 100A, 100D are either in direct skin contact with a single person or are each in direct skin contact with two different people who, in turn, are either in direct or indirect skin-to-skin contact with one another. Indirect skin-to-skin contact between two people is exemplified where, for example, each of the two is holding hands with a third person.

In accordance with another aspect, the external connection is two or more people and the electrical contacts 146 are in direct contact with two different people. It is important that the person contacting one electrical contact 146 is in indirect skin-to-skin contact with the other person contacting the other electrical contact 146.

Figure 3:
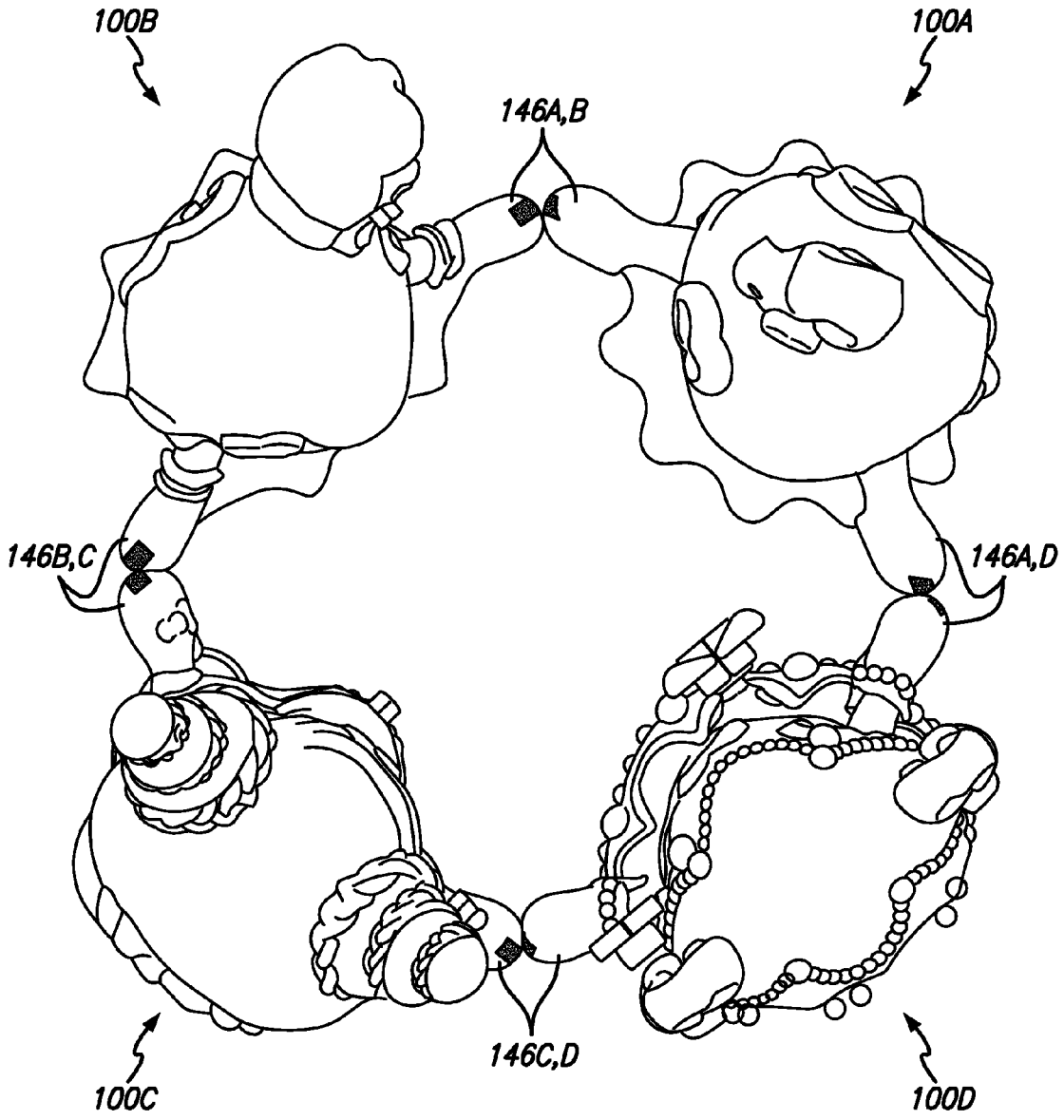
FIG. 3 illustrates a top view of a plurality of toy figurines coupled together to form a closed electrical circuit.

In accordance with a further aspect, the external connection may be provided by the arrangement of a plurality of toy figurines 100A, 100B, 100C, 100D in contact with one another at the electrical contacts 146 to close the electrical circuit, as shown in FIG. 3. In accordance with this aspect, the stimuli source will provide the response (e.g., turn on the LED light) until the contact between electrical contacts 146 of adjacent toy figurines is severed.

As shown in FIGS. 2 and 3, a plurality of toy figurines 100A, 100B, 100C, and 100D may be coupled to one another about the electrical contact. In order to facilitate the establishment and maintenance of this, magnets 144 may be provided. As shown in FIG. 1, the magnets 144 may be provided directly adjacent to the electrical contacts 146. In another embodiment, the magnets 144 may be provided in any other location that permits the positioning of adjacent toy figurines 100 to contact one another via their electrical contacts 146.

Figure 4:
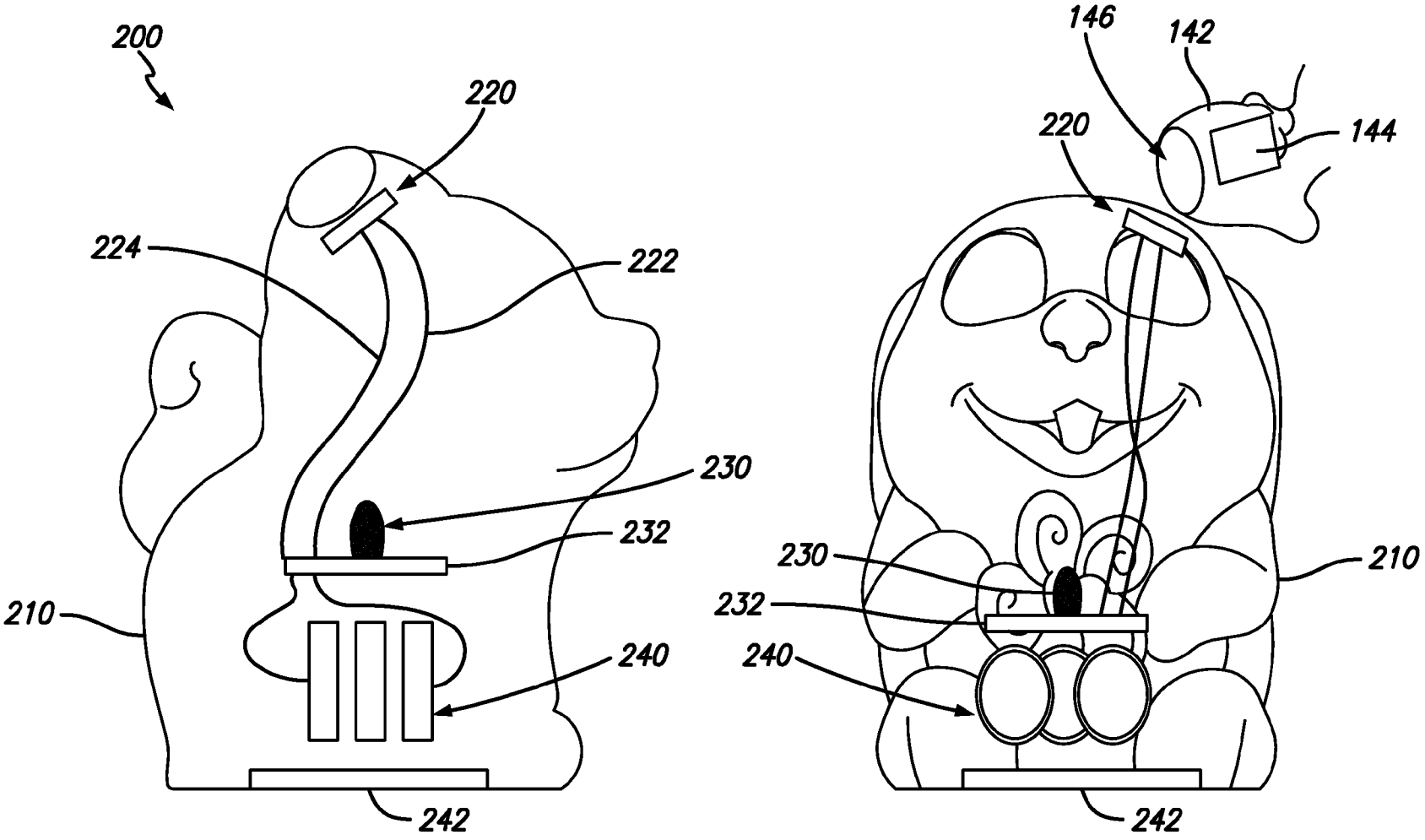
FIG. 4 illustrates schematic front and side views of an example embodiment toy accessory figurine.
Figure 5:
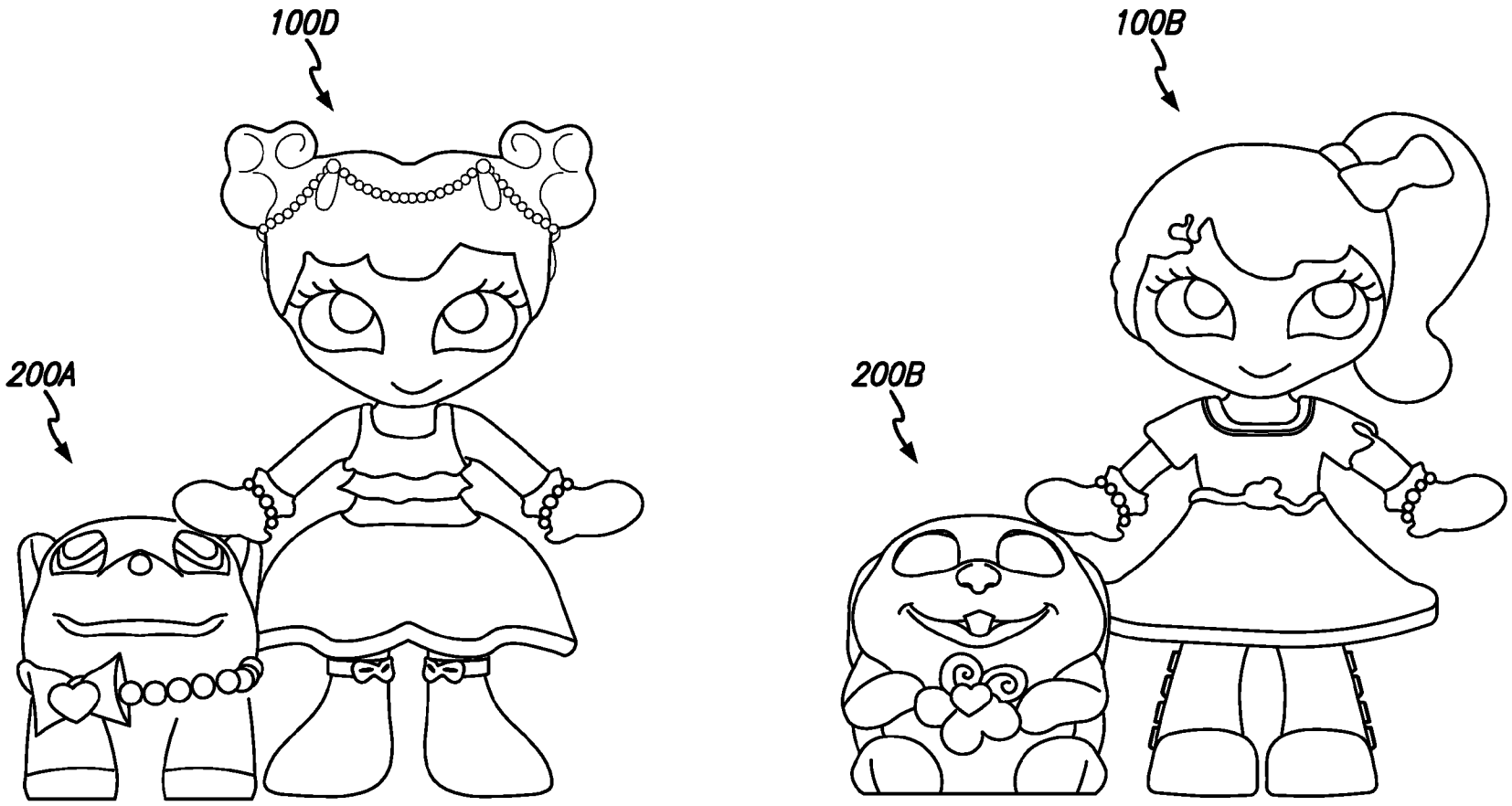
FIG. 5 illustrates front views of an example embodiment toy figurine coupled to the toy accessory figurine.

FIGS. 4-5 depict a toy accessory figurine 200 which may additionally be provided for use in connection with the toy figurine 100. Although the toy accessory figurine 200 is depicted to take the form and shape of a small animal or pet, it is understood that embodiments of the invention may take the form of any characters, real or fictional, or of any inanimate object, such as a purse or a structure, e.g., such as a house or the like, configured to accommodate the toy figurine therein.

The toy accessory figurine 200 comprises a body 210 having an external surface and an internal cavity. Disposed within the inner cavity is a magnetic switch 220 electrically coupled to a PCB 232 by electric wires 222, 224. The PCB 232, in turn, couples a stimuli source, such as an LED 230, to a power source, depicted as a plurality of batteries 240.

As with the toy figurine 100 depicted in FIGS. 1-3, the power source may be one or a plurality of batteries connected in series or in parallel. Alternatively, the power source may be a photovoltaic cell or other means by which an electrical current may be generated. The batteries 240 may removed and replaced via access door 242, which may further comprise screws or other means to secure the access door 242 closure.

Again, it is understood that the stimuli source may be any one or a combination of light, sound, motion and/or vibration. Where the stimuli source is light, an LED 230 as shown in FIG. 4 is preferred. Although not shown in FIG. 4, light reflectors may optionally be provided in proximity to the light source to direct light to a specific area or region of the toy accessory figurine 200. Because the light source 230 emanates from within the internal cavity of the toy accessory figurine 200, one or more select portions or the entirety of the body 210 of the figurine 200 may be made of a transparent, semi-transparent or translucent material that permits the light to shine through. It is understood that the stimuli source may be disposed in any location within the internal cavity or the exterior of the toy accessory figurine 200.

The magnetic switch 220 is depicted as being disposed within the inner cavity of the accessory figurine 200. The magnetic switch 220 is biased in an open configuration such that the electrical circuit represented in FIG. 4 is an open circuit. The magnetic switch 220 may be actuated in a closed configuration to close the circuit and to deliver power to activate the stimuli source, in this case the LED light 230 via the electric wires 222, 224 to turn on. In the embodiment shown in FIG. 5, the magnetic switch 220 may be actuated from the open configuration to the closed configuration by bringing the magnetic switch 220 in close proximity to a conductive metal, such as the metal forming the electrical contact 146 of the toy figurine 100.

The toy figurines 100 and the toy accessory figurines 200 permit any number of combinations with one another and with one or more persons to provide a level of interactivity and responsiveness that promotes a child's curiosity and imagination. It is to be understood that the detailed description and specific examples, while indicating example embodiments of the figurines as disclosed herein, are given by way of illustration and not limitation. Many changes and modifications within the scope of the figurines as disclosed herein may be made without departing from the spirit thereof, and such figurines are understood to include all such modifications.

What is claimed:

1. A toy figurine comprising:

a body having an internal cavity and an external surface, wherein the body comprises a head, and a pair of arms and legs;

a response unit being configured to deliver a response stimuli; and electrical contacts disposed outwardly from an external surface of terminal ends of opposing arms or legs extending from the body, the electrical contacts each being formed from a metallic material and coupled to the response unit by connectors;

wherein the response unit delivers the response stimuli when an electrical connection is made between the electrical contacts;

wherein the response stimuli comprises a light source disposed within the internal cavity of the body;

wherein at least a portion of the body is made of a transparent, semi-transparent or translucent material to permit light from the light source to be transmitted through the body to be visible from outside of the toy figurine; and a toy accessory figurine magnetically coupled to the toy figurine, wherein the toy accessory figurine comprises a magnetic switch that is in a closed position when coupled to the toy figurine, and wherein the toy accessory figurine comprises a response unit that delivers a response stimuli when the magnetic switch is in a closed position.

2. The toy figurine of claim 1, wherein the electrical contacts extend from terminal ends of the arms.

3. The toy figurine of claim 1 wherein the electrical connection is made by an external object.

4. The toy figurine of claim 3 wherein the external object is a person.

5. The toy figurine of claim 2, wherein the electrical contacts are dome-shaped.

6. The toy figurine of claim 1, further comprising magnets positioned adjacent one or more of the electrical contacts.

7. The toy figurine of claim 1, wherein the response unit comprises a printed circuit board (PCB).

8. The toy figurine of claim 1, wherein the response stimuli further comprises a response selected from the group consisting of sound, motion and combinations thereof.

9. The toy figurine of claim 1, wherein the response stimuli further comprises a reflector disposed adjacent the light source, the reflector being disposed within the internal cavity of the body.

10. The toy figurine of claim 1, further comprising a power source.

11. The toy figurine of claim 10, wherein the power source is one or more batteries.

* * * * *